US007492868B2

(12) United States Patent
Gorrell et al.

(10) Patent No.: US 7,492,868 B2
(45) Date of Patent: Feb. 17, 2009

(54) SOURCE OF X-RAYS

(75) Inventors: Jonathan Gorrell, Gainesville, FL (US); Mark Davidson, Florahome, FL (US)

(73) Assignee: Virgin Islands Microsystems, Inc., St. Thomas (VG)

( * ) Notice: Subject to any disclaimer, the term of this patent is extended or adjusted under 35 U.S.C. 154(b) by 0 days.

(21) Appl. No.: 11/411,131

(22) Filed: Apr. 26, 2006

(65) Prior Publication Data

US 2007/0253535 A1 Nov. 1, 2007

(51) Int. Cl.
*G21G 4/04* (2006.01)
*H01J 23/18* (2006.01)
*H05H 7/22* (2006.01)

(52) U.S. Cl. ..... 378/119; 315/500

(58) Field of Classification Search ..... 378/119, 378/121, 137, 138; 315/500–507
See application file for complete search history.

(56) References Cited

U.S. PATENT DOCUMENTS 1,948,384 A * 2/1934 Lawrence ..... 315/500
2,307,086 A * 1/1943 Varian et al. ..... 378/137
2,431,396 A 11/1947 Hansell
2,473,477 A * 6/1949 Smith ..... 313/62
2,634,372 A 4/1953 Salisbury
2,932,798 A * 4/1960 Kerst et al. ..... 315/503
2,944,183 A 7/1960 Drexler
2,966,611 A 12/1960 Sandstrom
3,231,779 A 1/1966 White
3,297,905 A 1/1967 Rockwell et al.
3,543,147 A 11/1970 Kovarik
3,571,642 A * 3/1971 Westcott ..... 315/505
3,586,899 A 6/1971 Fleisher
3,761,828 A * 9/1973 Pollard et al. ..... 315/505
3,886,399 A 5/1975 Symons
3,923,568 A 12/1975 Bersin
3,989,347 A 11/1976 Eschler (Continued)

FOREIGN PATENT DOCUMENTS

EP 0237559 B1 12/1991

(Continued)

OTHER PUBLICATIONS

"Array of Nanoklystrons for Frequency Agility or Redundancy," NASA's Jet Propulsion Laboratory, NASA Tech Briefs, NPO-21033. 2001.

(Continued)

*Primary Examiner*—Edward J Glick
*Assistant Examiner*—Anastasia Midkiff
(74) *Attorney, Agent, or Firm*—Davidson Berquist Jackson & Gowdey, LLP

(57) ABSTRACT

A charged particle beam including charged particles (e.g., electrons) is generated from a charged particle source (e.g., a cathode or scanning electron beam). As the beam is projected, it passes between plural alternating electric fields. The attraction of the charged particles to their oppositely charged fields accelerates the charged particles, thereby increasing their velocities in the corresponding (positive or negative) direction. The charged particles therefore follow an oscillating trajectory. When the electric fields are selected to produce oscillating trajectories having the same (or nearly the same) as a multiple of the frequency of the emitted x-rays, the resulting photons can be made to constructively interfere with each other to produce a coherent x-ray source.

25 Claims, 14 Drawing Sheets

U.S. PATENT DOCUMENTS

| | | | | |
|---|---|---|---|---|
| 4,282,436 | A | | 8/1981 | Kapetanakos |
| 4,482,779 | A | | 11/1984 | Anderson |
| 4,712,042 | A | * | 12/1987 | Hamm ..... 315/5.41 |
| 4,713,581 | A | | 12/1987 | Haimson |
| 4,727,550 | A | | 2/1988 | Chang et al. |
| 4,740,973 | A | | 4/1988 | Madey |
| 4,746,201 | A | | 5/1988 | Gould |
| 4,806,859 | A | | 2/1989 | Hetrick |
| 4,829,527 | A | | 5/1989 | Wortman et al. |
| 4,838,021 | A | | 6/1989 | Beattie |
| 4,864,131 | A | | 9/1989 | Rich et al. |
| 5,023,563 | A | | 6/1991 | Harvey et al. |
| 5,113,141 | A | | 5/1992 | Swenson |
| 5,128,729 | A | | 7/1992 | Alonas et al. |
| 5,157,000 | A | | 10/1992 | Elkind et al. |
| 5,163,118 | A | | 11/1992 | Lorenzo et al. |
| 5,185,073 | A | | 2/1993 | Bindra |
| 5,199,918 | A | | 4/1993 | Kumar |
| 5,235,248 | A | | 8/1993 | Clark et al. |
| 5,262,656 | A | | 11/1993 | Blondeau et al. |
| 5,263,043 | A | | 11/1993 | Walsh |
| 5,268,693 | A | | 12/1993 | Walsh |
| 5,268,788 | A | | 12/1993 | Fox et al. |
| 5,302,240 | A | | 4/1994 | Hori et al. |
| 5,354,709 | A | | 10/1994 | Lorenzo et al. |
| 5,446,814 | A | | 8/1995 | Kuo et al. |
| 5,504,341 | A | * | 4/1996 | Glavish ..... 250/492.21 |
| 5,578,909 | A | | 11/1996 | Billen |
| 5,608,263 | A | | 3/1997 | Drayton et al. |
| 5,666,020 | A | | 9/1997 | Takemura |
| 5,668,368 | A | | 9/1997 | Sakai et al. |
| 5,705,443 | A | | 1/1998 | Stauf et al. |
| 5,737,458 | A | | 4/1998 | Wojnarowski et al. |
| 5,744,919 | A | | 4/1998 | Mishin et al. |
| 5,757,009 | A | | 5/1998 | Walstrom |
| 5,767,013 | A | | 6/1998 | Park |
| 5,790,585 | A | | 8/1998 | Walsh |
| 5,811,943 | A | | 9/1998 | Mishin et al. |
| 5,821,836 | A | | 10/1998 | Katehi et al. |
| 5,821,902 | A | | 10/1998 | Keen |
| 5,825,140 | A | * | 10/1998 | Fujisawa ..... 315/505 |
| 5,831,270 | A | | 11/1998 | Nakasuji |
| 5,847,745 | A | | 12/1998 | Shimizu et al. |
| 5,889,449 | A | | 3/1999 | Fiedziuszko |
| 5,902,489 | A | | 5/1999 | Yasuda et al. |
| 5,963,857 | A | | 10/1999 | Greywall |
| 6,008,496 | A | | 12/1999 | Winefordner et al. |
| 6,040,625 | A | | 3/2000 | Ip |
| 6,060,833 | A | | 5/2000 | Velazco |
| 6,080,529 | A | | 6/2000 | Ye et al. |
| 6,139,760 | A | | 10/2000 | Shim et al. |
| 6,180,415 | B1 | | 1/2001 | Schultz et al. |
| 6,195,199 | B1 | | 2/2001 | Yamada |
| 6,222,866 | B1 | | 4/2001 | Seko |
| 6,278,239 | B1 | | 8/2001 | Caporaso et al. |
| 6,281,769 | B1 | | 8/2001 | Fiedziuszko |
| 6,297,511 | B1 | | 10/2001 | Syllaios et al. |
| 6,316,876 | B1 | | 11/2001 | Tanabe |
| 6,338,968 | B1 | | 1/2002 | Hefti |
| 6,370,306 | B1 | | 4/2002 | Sato et al. |
| 6,373,194 | B1 | | 4/2002 | Small |
| 6,376,258 | B2 | | 4/2002 | Hefti |
| 6,407,516 | B1 | | 6/2002 | Victor |
| 6,441,298 | B1 | | 8/2002 | Thio |
| 6,453,087 | B2 | | 9/2002 | Frish et al. |
| 6,470,198 | B1 | | 10/2002 | Kintaka et al. |
| 6,504,303 | B2 | | 1/2003 | Small |
| 6,525,477 | B2 | | 2/2003 | Small |
| 6,545,425 | B2 | | 4/2003 | Victor |
| 6,552,320 | B1 | | 4/2003 | Pan |
| 6,577,040 | B2 | | 6/2003 | Nguyen |
| 6,603,915 | B2 | | 8/2003 | Glebov et al. |
| 6,624,916 | B1 | | 9/2003 | Green et al. |
| 6,636,185 | B1 | | 10/2003 | Spitzer et al. |
| 6,636,653 | B2 | | 10/2003 | Miracky et al. |
| 6,640,023 | B2 | | 10/2003 | Miller et al. |
| 6,642,907 | B2 | | 11/2003 | Hamada et al. |
| 6,687,034 | B2 | | 2/2004 | Wine et al. |
| 6,738,176 | B2 | | 5/2004 | Rabinowitz et al. |
| 6,741,781 | B2 | | 5/2004 | Furuyama |
| 6,782,205 | B2 | | 8/2004 | Trisnadi et al. |
| 6,791,438 | B2 | | 9/2004 | Takahashi et al. |
| 6,829,286 | B1 | | 12/2004 | Guilfoyle et al. |
| 6,834,152 | B2 | | 12/2004 | Gunn et al. |
| 6,870,438 | B1 | | 3/2005 | Shino et al. |
| 6,871,025 | B2 | | 3/2005 | Maleki et al. |
| 6,885,262 | B2 | | 4/2005 | Nishimura et al. |
| 6,909,092 | B2 | | 6/2005 | Nagahama |
| 6,909,104 | B1 | | 6/2005 | Koops |
| 6,943,650 | B2 | | 9/2005 | Ramprasad et al. |
| 6,944,369 | B2 | | 9/2005 | Deliwala |
| 6,953,291 | B2 | | 10/2005 | Liu |
| 6,965,284 | B2 | | 11/2005 | Maekawa et al. |
| 6,965,625 | B2 | | 11/2005 | Mross et al. |
| 6,972,439 | B1 | | 12/2005 | Kim et al. |
| 6,995,406 | B2 | | 2/2006 | Tojo et al. |
| 7,010,183 | B2 | | 3/2006 | Estes et al. |
| 7,092,588 | B2 | | 8/2006 | Kondo |
| 7,092,603 | B2 | | 8/2006 | Glebov et al. |
| 7,122,978 | B2 | | 10/2006 | Nakanishi et al. |
| 7,177,515 | B2 | | 2/2007 | Estes et al. |
| 7,230,201 | B1 | | 6/2007 | Miley et al. |
| 7,267,459 | B2 | | 9/2007 | Matheson |
| 7,267,461 | B2 | | 9/2007 | Kan et al. |
| 7,375,631 | B2 | | 5/2008 | Moskowitz et al. |
| 2001/0025925 | A1 | | 10/2001 | Abe et al. |
| 2002/0009723 | A1 | | 1/2002 | Hefti |
| 2002/0027481 | A1 | | 3/2002 | Fiedziuszko |
| 2002/0036121 | A1 | | 3/2002 | Ball et al. |
| 2002/0036264 | A1 | | 3/2002 | Nakasuji et al. |
| 2002/0053638 | A1 | | 5/2002 | Winkler et al. |
| 2002/0068018 | A1 | | 6/2002 | Pepper et al. |
| 2002/0071457 | A1 | | 6/2002 | Hogan |
| 2002/0135665 | A1 | | 9/2002 | Gardner |
| 2003/0012925 | A1 | | 1/2003 | Gorrell |
| 2003/0016412 | A1 | | 1/2003 | Small |
| 2003/0016421 | A1 | | 1/2003 | Small |
| 2003/0034535 | A1 | | 2/2003 | Barenburu et al. |
| 2003/0103150 | A1 | | 6/2003 | Catrysse et al. |
| 2003/0155521 | A1 | | 8/2003 | Feuerbaum |
| 2003/0158474 | A1 | | 8/2003 | Scherer et al. |
| 2003/0164947 | A1 | | 9/2003 | Vaupel |
| 2003/0179974 | A1 | | 9/2003 | Estes et al. |
| 2003/0206708 | A1 | | 11/2003 | Estes et al. |
| 2003/0214695 | A1 | | 11/2003 | Abramson et al. |
| 2004/0061053 | A1 | | 4/2004 | Taniguchi et al. |
| 2004/0085159 | A1 | | 5/2004 | Kubena et al |
| 2004/0108473 | A1 | | 6/2004 | Melnychuk et al. |
| 2004/0136715 | A1 | | 7/2004 | Kondo |
| 2004/0150991 | A1 | | 8/2004 | Ouderkirk et al. |
| 2004/0171272 | A1 | | 9/2004 | Jin et al. |
| 2004/0180244 | A1 | | 9/2004 | Tour et al. |
| 2004/0184270 | A1 | | 9/2004 | Halter |
| 2004/0213375 | A1 | | 10/2004 | Bjorkholm et al. |
| 2004/0217297 | A1 | | 11/2004 | Moses et al. |
| 2004/0218651 | A1 | | 11/2004 | Iwasaki et al. |
| 2004/0231996 | A1 | | 11/2004 | Webb |
| 2004/0240035 | A1 | | 12/2004 | Zhilkov |
| 2004/0264867 | A1 | | 12/2004 | Kondo |
| 2005/0023145 | A1 | | 2/2005 | Cohen et al. |
| 2005/0045821 | A1 | | 3/2005 | Noji et al. |
| 2005/0045832 | A1 | | 3/2005 | Kelly et al. |
| 2005/0054151 | A1 | | 3/2005 | Lowther et al. |
| 2005/0067286 | A1 | | 3/2005 | Ahn et al. |

| | | | | |
|---|---|---|---|---|
| 2005/0082469 | A1 | 4/2005 | Carlo | |
| 2005/0092929 | A1 | 5/2005 | Schneiker | |
| 2005/0105690 | A1 | 5/2005 | Pau et al. | |
| 2005/0145882 | A1 | 7/2005 | Taylor et al. | |
| 2005/0162104 | A1 | 7/2005 | Victor et al. | |
| 2005/0190637 | A1 | 9/2005 | Ichimura et al. | |
| 2005/0194258 | A1 | 9/2005 | Cohen et al. | |
| 2005/0201707 | A1 | 9/2005 | Glebov et al. | |
| 2005/0201717 | A1 | 9/2005 | Matsumura et al. | |
| 2005/0212503 | A1 | 9/2005 | Deibele | |
| 2005/0231138 | A1* | 10/2005 | Nakanishi et al. | 315/500 |
| 2005/0248451 | A1 | 11/2005 | Baehr-Jones et al. | |
| 2005/0285541 | A1 | 12/2005 | LeChevalier | |
| 2006/0007730 | A1 | 1/2006 | Nakamura et al. | |
| 2006/0018619 | A1 | 1/2006 | Helffrich et al. | |
| 2006/0035173 | A1 | 2/2006 | Davidson et al. | |
| 2006/0045418 | A1 | 3/2006 | Cho et al. | |
| 2006/0060782 | A1 | 3/2006 | Khursheed | |
| 2006/0062258 | A1 | 3/2006 | Brau et al. | |
| 2006/0159131 | A1 | 7/2006 | Liu et al. | |
| 2006/0164496 | A1 | 7/2006 | Tokutake et al. | |
| 2006/0208667 | A1 | 9/2006 | Lys et al. | |
| 2006/0243925 | A1 | 11/2006 | Barker et al. | |
| 2006/0274922 | A1 | 12/2006 | Ragsdale | |
| 2007/0003781 | A1 | 1/2007 | de Rochemont | |
| 2007/0013765 | A1 | 1/2007 | Hudson et al. | |
| 2007/0075264 | A1 | 4/2007 | Gorrell et al. | |
| 2007/0086915 | A1 | 4/2007 | LeBoeuf et al. | |
| 2007/0116420 | A1 | 5/2007 | Estes et al. | |
| 2007/0200940 | A1 | 8/2007 | Gruhike et al. | |
| 2007/0284527 | A1 | 12/2007 | Zani et al. | |

FOREIGN PATENT DOCUMENTS

| | | | |
|---|---|---|---|
| JP | 2004-032323 | A | 1/2004 |
| WO | WO 87/01873 | | 3/1987 |
| WO | WO 93/21663 | A1 | 10/1993 |
| WO | WO 00/72413 | | 11/2000 |
| WO | WO 02/025785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2006/042239 | A2 | 4/2006 |

OTHER PUBLICATIONS

"Hardware Development Programs," Calabazas Creek Research, Inc. found at http://calcreek.com/hardware.html.

"Antenna Arrays." May 18, 2002. www.tpub.com/content/neets/css/14183_159.htm.

"Diffraction Grating," hyperphysics.phy-astr.gsu.edu/hbase/phyopt/grating.html.

Alford, T.L. et al., "Advanced silver-based metallization patterning for ULSI application," Microelectronic Engineering 55, 2001, pp. 383-388, Elsevier Science B.V.

Amato, Ivan, "An Everyman's Free-Electron Laser?" Science, New Series, Oct. 16, 1992, p. 401, vol. 258 No. 5081, American Association for the Advancement of Science.

Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.

Backe, H. et al. "Investigation of Far-Infrared Smith-Purcell Radiation at the 3.41 MeV Electron Injector Linac of the Mainz Microtron MAMI," Institut fur Kernphysik, Universitat Mainz, D-55099, Mainz Germany.

Bakhtyari, A. et al., "Horn Resonator Boosts Miniature Free-Electron Laser Power," Applied Physics Letters, May 12, 2003, pp. 3150-3152, vol. 82, No. 19, American Institue of Physics.

Bakhtyari, Dr. Arash, "Gain Mechanism in a Smith-Purcell MicroFEL," Abstract, Department of Physics and Astronomy, Dartmouth College.

Bhattacharjee, Sudeep et al., "Folded Waveguide Traveling-Wave Tube Sources for Terahertz Radiation," IEEE Transactions on Plasma Science, vol. 32. No. 3, Jun. 2004, pp. 1002-1014.

Booske, J.H. et al., "Microfabricated TWTs as High Power, Wideband Sources of THz Radiation".

Brau, C.A. et al., "Gain and Coherent Radiation from a Smith-Purcell Free Electron Laser," Proceedings of the 2004 FEL Conference, pp. 278-281.

Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.

Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.

Chuang, S.L. et al., "Enhancement of Smith-Purcell Radiation from a Grating with Surface-Plasmon Excitation," Journal of the Optical Society of America, Jun. 1984, pp. 672-676, vol. 1, No. 6, Optical Society of America.

Chuang, S.L. et al., "Smith-Purcell Radiation from a Charge Moving Above a Penetrable Grating," IEEE MTT-S Digest, 1983, pp. 405-406, IEEE.

Far-IR, Sub-MM & MM Detector Technology Workshop list of manuscripts, session 6 2002.

Feltz, W.F. et al., "Near-Continuous Profiling of Temperature, Moisture, and Atmospheric Stability Using the Atmospheric Emitted Radiance Interferometer (AERI)," Journal of Aplied Meteorology, May 2003, vol. 42 No. 5, H.W. Wilson Company, pp. 584-597.

Freund, H.P. et al., "Linearized Field Theory of a Smith-Purcell Traveling Wave Tube," IEEE Transactions on Plasma Science, Jun. 2004, pp. 1015-1027, vol. 32, No. 3, IEEE.

Gallerano, G.P. et al., "Overview of Terahertz Radiation Sources," Proceedings of the 2004 FEL Conference, pp. 216-221.

Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.

Gover, A. et al., "Angular Radiation Pattern of Smith-Purcell Radiation," Journal of the Optical Society of America, Oct. 1984, pp. 723-728, vol. 1 No. 5, Optical Society of America.

Grishin, Yu et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.

Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.

Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.

Ives, Lawrence et al., "Development of Backward Wave Oscillators for Terahertz Applications," Terahertz for Military and Security Applications, Proceedings of SPIE vol. 5070 (2003), pp. 71-82.

Ives, R. Lawrence, "IVEC Summary, Session 2, Sources I" 2002.

Jonietz, Erika, "Nano Antenna Gold nanospheres show path to all-optical computing," Technology Review, Dec. 2005/Jan. 2006, p. 32.

Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.

Joo, Youngcheol et al., "Fabrication of Monolithic Microchannels for IC Chip Cooling," 1995, Mechanical, Aerospace and Nuclear Engineering Department, University of California at Los Angeles.

Jung, K.B. et al., "Patterning of Cu, Co, Fe, and Ag for magnetic nanostructures," J. Vac. Sci. Technol. A 15(3), May/Jun. 1997, pp. 1780-1784.

Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.

Kiener, C. et al., "Investigation of the Mean Free Path of Hot Electronics in GaAs/AlGaAs Heterostructures," Semicond. Sci. Technol., 1994, pp. 193-197, vol. 9, IOP Publishing Ltd., United Kingdom.

Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Korbly, S.E. et al., "Progress on a Smith-Purcell Radiation Bunch Length Diagnostic," Plasma Science and Fusion Center, MIT, Cambridge, MA.
Kormann, T. et al., "A Photoelectron Source for the Study of Smith-Purcell Radiation".
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
Manohara, Harish M. et al., "Design and Fabrication of a THz Nanoklystron".
Manohara, Harish M. et al., "Design and Fabrication of a THz Nanoklystron" (www.sofia.usra.edu/det_workshop/ posters/session 3/3-43manohara_poster.pdf), PowerPoint Presentation.
McDaniels, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J. Vac. Sci. Technol. B 19(1), Jan./Feb. 2001, American Vacuum Society, pp. 158-165.
Nguyen, Phucanh et al., "Reactive ion etch of patterned and blanket silver thin films in Cl2/O2 and O2 glow discharges," J. Vac. Sci, Technol. B. 17 (5), Sep./Oct. 1999, Amercian Vacuum Society, pp. 2204-2209.
Ohtaka, Kazuo, "Smith-Purcell Radiation from Metallic and Dielectric Photonic Crystals," Center for Frontier Science, pp. 272-273, Chiba University, 1-33 Yayori, Inage-ku, Chiba-shi, Japan.
Phototonics Research, "Surface-Plasmon-Enhanced Random Laser Demonstrated," Phototonics Spectra, Feb. 2005, pp. 112-113.
Platt, C.L. et al., "A New Resonator Design for Smith-Purcell Free Electron Laser," 6Q19, p. 296.
Potylitsin, A.P., "Resonant Diffraction Radiation and Smith-Purcell Effect," (Abstract), arXiv: physics/9803043 v2 13 Apr. 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Saviolv, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No, 8, American Institute of Physics.
Schachter, Levi "Influence of the Guiding Magnetic Field on the Performance of a Smith-Purcell Amplifier Operating in the Weak Compton Regime," Journal of the Optical Society of America, May 1990, pp. 873-876, vol. 7, No. 5, Optical Society of America.
Schachter, Levi "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7, No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Lee Kwang-Cheol et al., "Deep X-Ray Mask with Integrated Actuator for 3D Microfabrication", Conference: Pacific Rim Workshop on Tranducers and Micro/Nano Technologies, (Xiamen CHN), Jul. 22, 2002.
Markoff, John, "A Chip That Can Transfer Data Using Laser Light," The New York Times, Sep. 18, 2006.
S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Seach Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Speller et al., "A Low-Noise MEMS Accelerometer for Unattended Ground Sensor Applications", Applied MEMS Inc., 12200 Parc Crest, Stafford, TX, USA 77477.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.

Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
Neo et al., "Smith-Purcell Radiation from Ultraviolet to Infrared Using a Si-field Emitter" Vacuum Electronics Conference, 2007, IVEC '07, IEEE International May 2007.
Search Report and Written Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.

* cited by examiner

SOURCE OF X-RAYS

CROSS-REFERENCE TO CO-PENDING APPLICATIONS

The present invention is related to the following co-pending U.S. Patent applications: (1) U.S. patent application Ser. No. 11/238,991, entitled "Ultra-Small Resonating Charged Particle Beam Modulator," and filed Sep. 30, 2005, (2) U.S. patent application Ser. No. 10/917,511, filed on Aug. 13, 2004, entitled "Patterning Thin Metal Film by Dry Reactive Ion Etching," and to U.S. application Ser. No. 11/203,407, filed on Aug. 15, 2005, entitled "Method Of Patterning Ultra-Small Structures," (3) U.S. application Ser. No. 11/243,476, entitled "Structures And Methods For Coupling Energy From An Electromagnetic Wave," filed on Oct. 5, 2005, (4) U.S. application Ser. No. 11/243,477, entitled "Electron Beam Induced Resonance," filed on Oct. 5, 2005, (5) U.S. application Ser. No. 11/411,130, entitled "Charged Particle Acceleration Apparatus and Method," filed on even date herewith; and (6) U.S. application Ser. No. 11/411,129, entitled "Micro Free Electron Laser (FEL)," filed on even date herewith, all of which are commonly owned with the present application at the time of filing, and the entire contents of each of which are incorporated herein by reference.

BACKGROUND OF THE INVENTION

1. Field of the Invention

The present invention is directed to structures and methods of (positively or negatively) accelerating charged particles, and in one embodiment to structures and methods of accelerating electrons in an electron beam using a resonant structure which resonates at a frequency higher than a microwave frequency such that the structures and methods emit x-rays in interference patterns that enable the x-rays to be used as a coherent source of x-rays.

2. Discussion of the Background

It is possible to emit a beam of charged particles according to a number of known techniques. Electron beams are currently being used in semiconductor lithography operations, such as in U.S. Pat. No. 6,936,981. The abstract of that patent also discloses the use of a "beam retarding system [that] generates a retarding electric potential about the electron beams to decrease the kinetic energy of the electron beams substantially near a substrate."

An alternate charged particle source includes an ion beam. One such ion beam is a focused ion beam (FIB) as disclosed in U.S. Pat. No. 6,900,447 which discloses a method and system for milling. That patent discloses that "The positively biased final lens focuses both the high energy ion beam and the relatively low energy electron beam by functioning as an acceleration lens for the electrons and as a deceleration lens for the ions." Col. 7, lines 23-27.

X-rays are used in a number of medical procedures. Most commonly x-rays are used to examine internal bones or organs to look for abnormalities (e.g., broken bones). Current x-ray sources do not, however, produce coherent x-rays. Coherent x-rays are advantageous in that they have small beam spread, and are more easily manipulated by diffraction, allowing more information to be obtained, or more concentrated doses to be delivered.

SUMMARY OF THE INVENTION

It is an object of the present invention to provide a series of alternating electric fields to accelerate or decelerate charged particles being emitted from a charged particle source such that the charged particles emit photons in constructively interfering patterns that enable the resulting x-rays to be used as a coherent source of x-rays.

According to one embodiment of the present invention, a series of alternating electric fields provides transverse acceleration of charged particles (e.g., electrons) passing through the electric fields such that photons are emitted in phase with each other.

BRIEF DESCRIPTION OF THE DRAWINGS

For a more complete understanding of the present invention, and the advantages thereof, reference is now made to the following descriptions taken in conjunction with the accompanying drawings, in which.

DISCUSSION OF THE PREFERRED EMBODIMENTS

Figure 1:
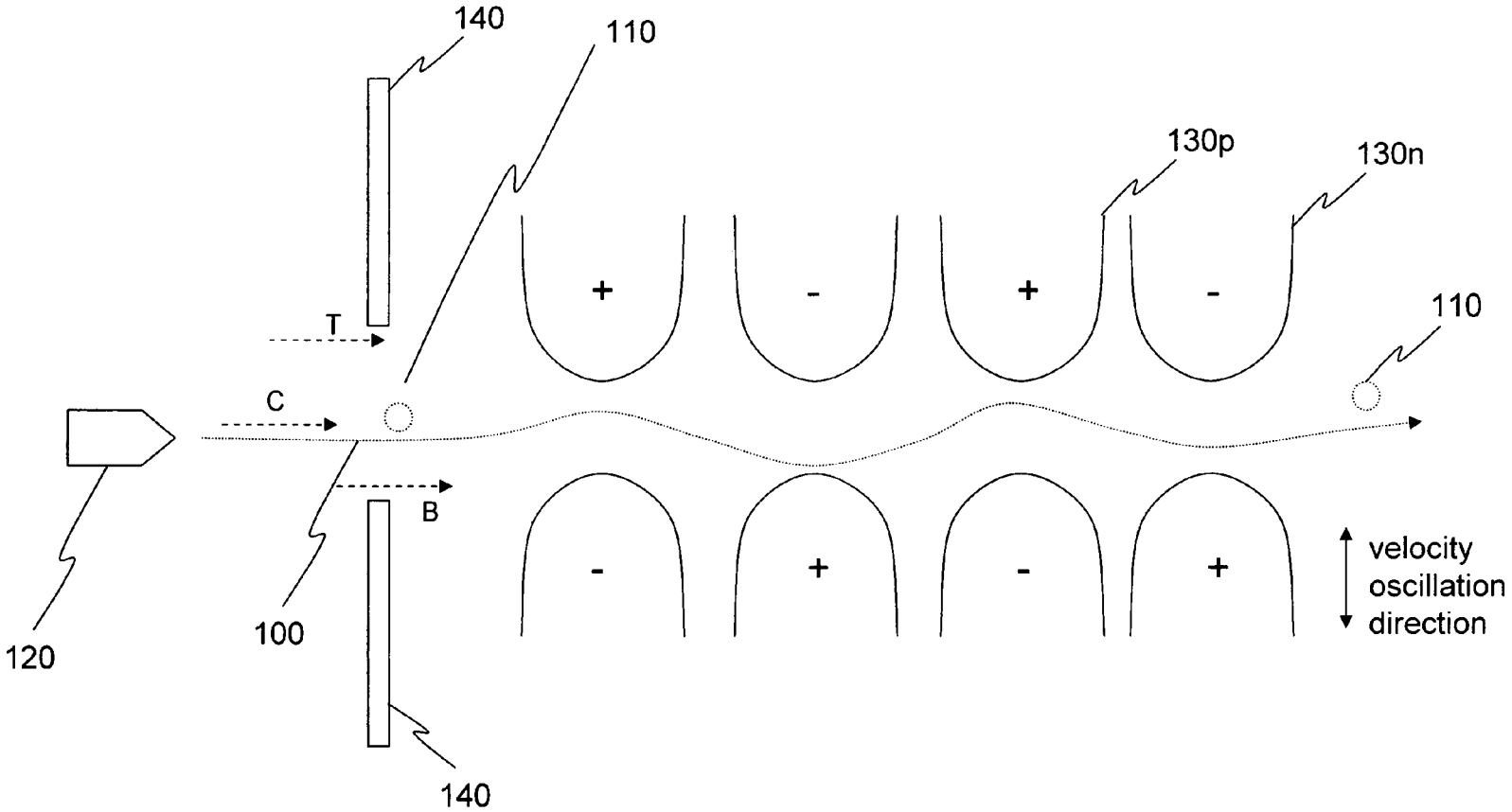
FIG. 1 is a top-view, high-level conceptual representation of a charged particle moving through a series of alternating electric fields according to a first embodiment of the present invention.

Turning now to the drawings, FIG. 1 is a high-level conceptual representation of a charged particle moving through a series of alternating electric fields according to a first embodiment of the present invention. As shown therein, a charged particle beam 100 including charged particles 110 (e.g., electrons) is generated from a charged particle source 120. (The charged particle beam 100 can include ions (positive or negative), electrons, protons and the like. The beam may be produced by any source, including, e.g., without limitation an ion gun, a thermionic filament, a tungsten filament, a cathode, a planar vacuum triode, an electron-impact ionizer, a laser ionizer, a chemical ionizer, a thermal ionizer, an ion-impact ionizer)

As the beam 100 is projected, it passes between plural alternating electric fields 130*p* and 130*n*. The fields 130*p* represent positive electric fields on the upper portion of the figure, and the fields 130*n* represent negative electric fields on the upper portion of the figure. In this first embodiment, the electric fields 130*p* and 130*n* alternate not only on the same side but across from each other as well. That is, each positive electric field 130*p* is surrounded by a negative electric field 130*n* on three sides. Likewise, each negative electric field 130*n* is surrounded by a positive field 130*p* on three sides. In the illustrated embodiment, the charged particles 110 are electrons which are attracted to the positive electric fields 130*p* and repelled by the negative electric fields 130*n*. The attraction of the charged particles 110 to their oppositely charged fields 130*p* or 130*n* accelerates the charged particles 110 transversely to their axial velocity.

The series of alternating fields creates an oscillating path in the directions of top to bottom of FIG. 1 and as indicated by the legend "velocity oscillation direction." In such a case, the velocity oscillation direction is generally perpendicular to the direction of motion of the beam 100.

The charged particle source 120 may also optionally include one or more electrically biased electrodes 140 (e.g., (a) grounding electrodes or (b) positively biased electrodes) which help to keep the charged particles (e.g., (a) electrons or negatively charged ions or (b) positively charged ions) on the desired path.

Figure 2:
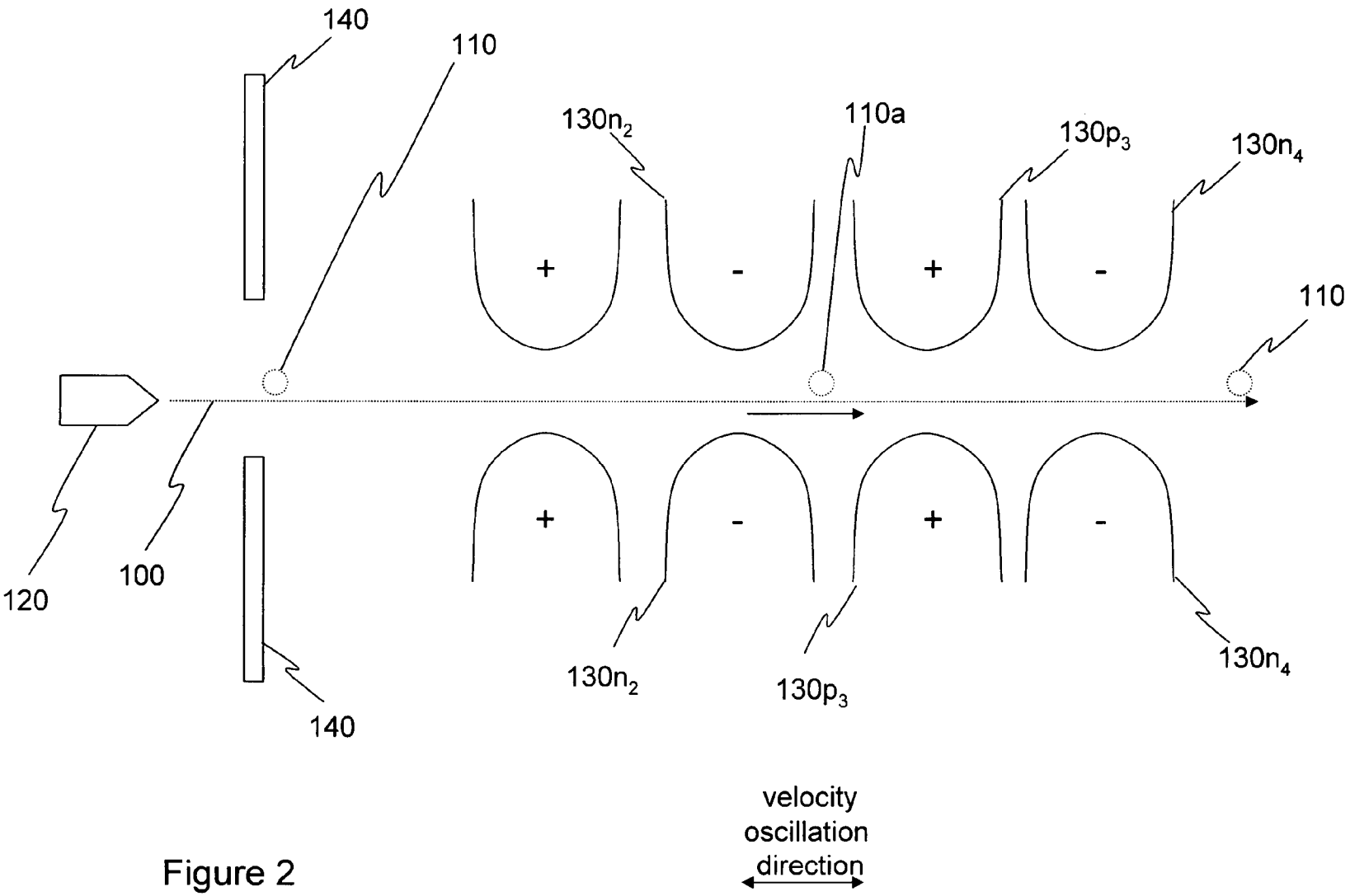
FIG. 2 is a top-view, high-level conceptual representation of a charged particle accelerating while being influenced by at least one field of a series of alternating electric fields according to a second embodiment of the present invention.
Figure 3:
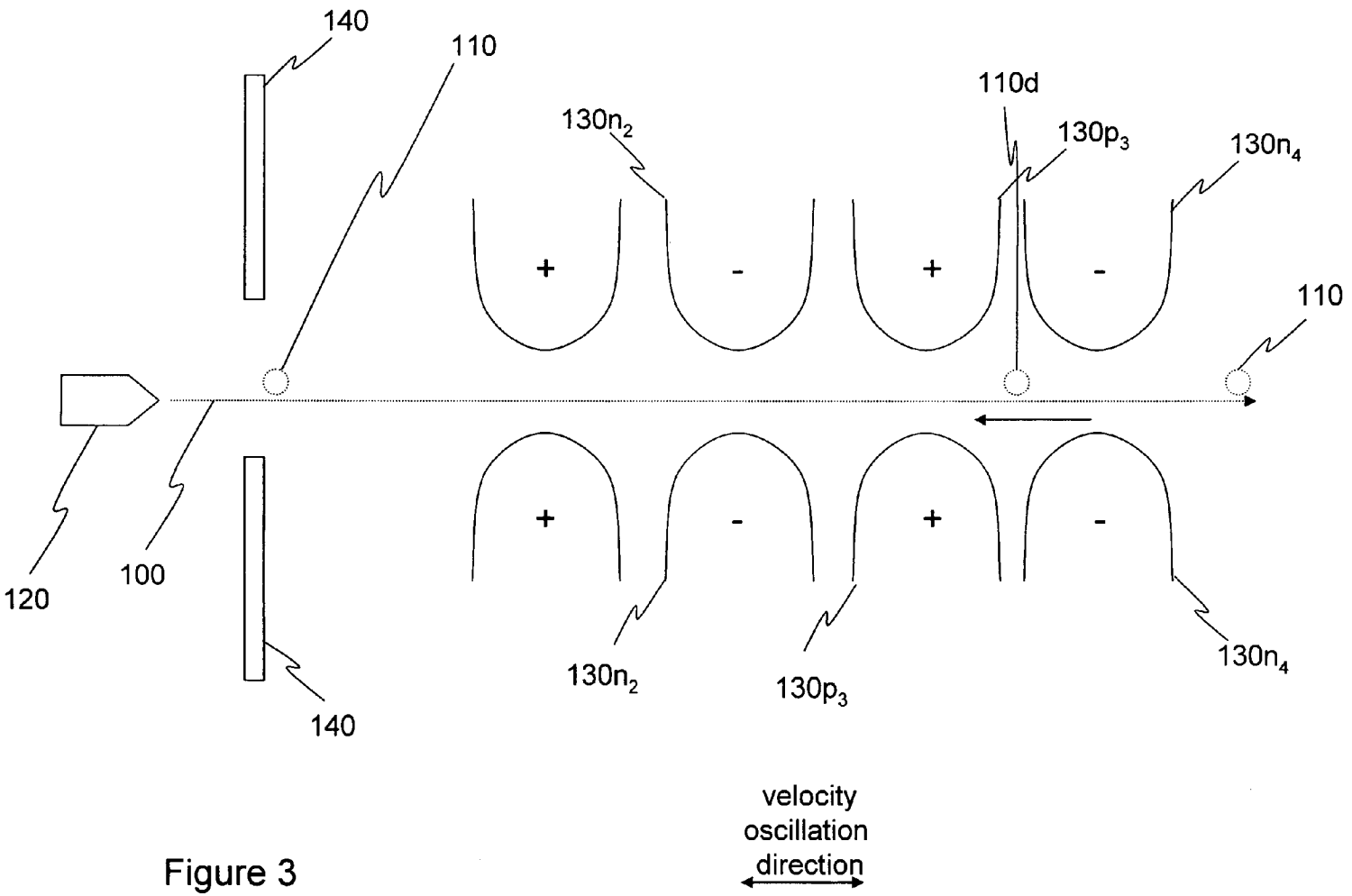
FIG. 3 is a top-view, high-level conceptual representation of a charged particle decelerating while being influenced by at least one field of a series of alternating electric fields according to a second embodiment of the present invention.

In the alternate embodiments illustrated in FIGS. 2 and 3, various elements from FIG. 1 have been repeated, and their reference numerals are repeated in FIGS. 2 and 3. However, the order of the electric fields 130*p* and 130*n* below the path of the charged particle beam 100 has been changed. In FIGS. 2 and 3, while the electric fields 130*n* and 130*p* are still alternating on the same side, they are now the same polarity on opposite sides of the beam 100. Thus, in the case of an electron acting as a charged particle 110, the electron 110*a* in FIG. 2 is an accelerating electron that is being accelerated by being repelled from the negative fields $\mathbf{130}n_2$ while being attracted to the next positive fields $\mathbf{130}p_3$ in the direction of motion of the beam 100. (The direction of acceleration is shown below the accelerating electron 110*a*.)

Conversely, as shown in FIG. 3, in the case of an electron acting as a charged particle 110, the electron 110*d* in FIG. 2 is a decelerating electron that is being decelerated (i.e., negatively accelerated) as it approaches the negative fields $\mathbf{130}n_4$ while still being attracted to the previous positive fields $\mathbf{130}p_3$. The direction of acceleration is shown below the decelerating electron 110*d*. Moreover, both FIGS. 2 and 3 include the legend "velocity oscillation direction" showing the direction of the velocity changes. In such cases, the velocity oscillation direction is generally parallel to the direction of motion of the beam 100.

By varying the order and strength of the electric fields 130*n* and 130*p*, a variety of accelerations, and therefore motions, can be created. As should be understood from the disclosure, the strengths of adjacent electric fields, fields on the same side of the beam 100 and fields on opposite sides of the beam 100 need not be the same strength. Moreover, the strengths of the fields and the polarities of the fields need not be fixed either but may instead vary with time. The fields 130*n* and 130*p* may even be created by applying a electromagnetic wave to a resonant structure, described in greater detail below.

The electric fields utilized by the present invention can be created by any known method which allows sufficiently fine-grained control over the paths of the charged particles that they stay within intended path boundaries.

According to one aspect of the present invention, the electric fields can be generated using at least one resonant structure where the resonant structure resonates at a frequency above a microwave frequency. Resonant structures include resonant structures shown in or constructed by the teachings of the above-identified co-pending applications. In particular, the structures and methods of U.S. application Ser. No. 11/243,477, entitled "Electron Beam Induced Resonance," filed on Oct. 5, 2005, can be utilized to create electric fields 130 for use in the present invention.

Figure 4:
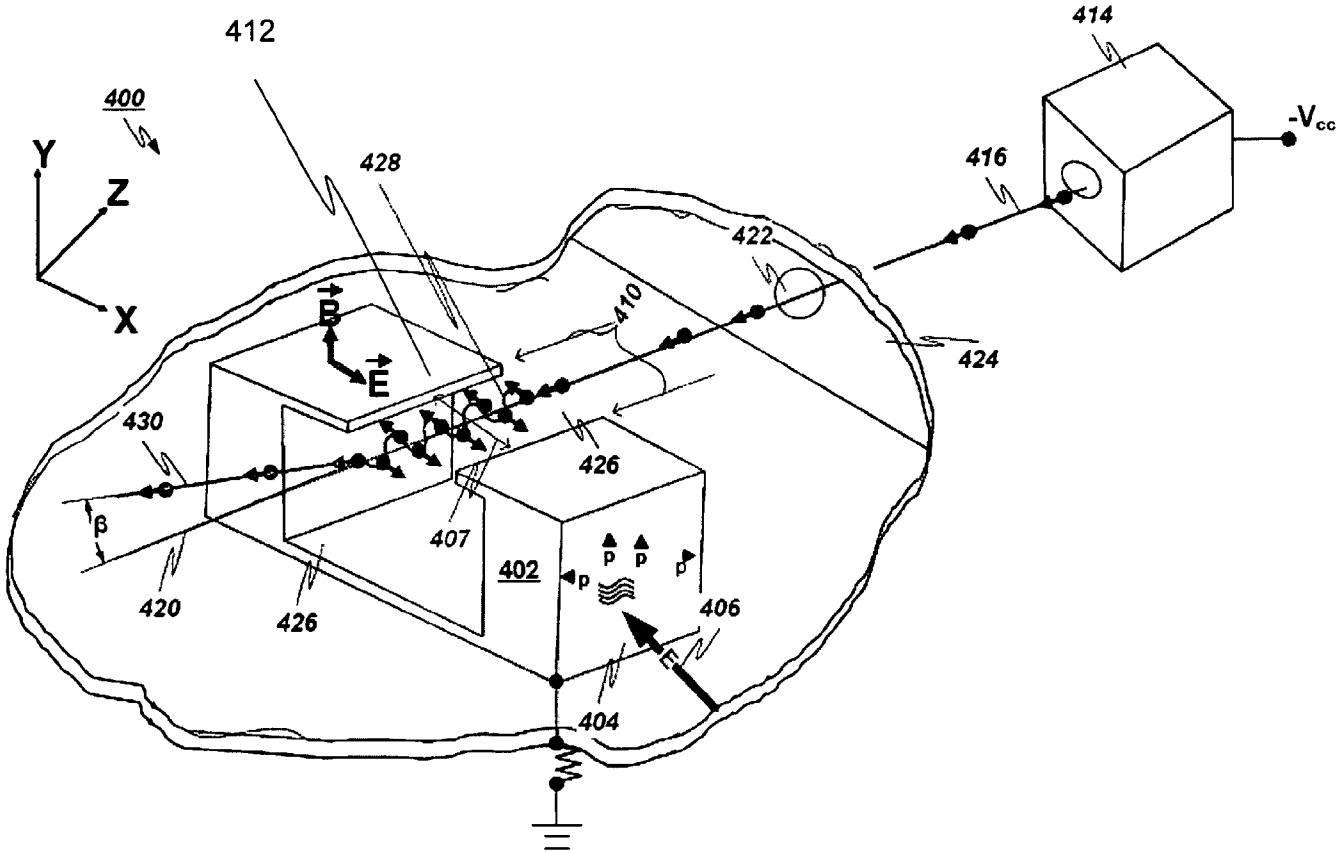
FIG. 4 is a perspective-view, high-level conceptual representation of a charged particle moving through a series of alternating electric fields produced by a resonant structure.

FIG. 4 is a perspective-view, high-level conceptual representation of a charged particle moving through a series of alternating electric fields produced by a resonant structure (RS) 402 (e.g., a microwave resonant structure or an optical resonant structure). An electromagnetic wave 406 (also denoted E) incident to a surface 404 of the RS 402 transfers energy to the RS 402, which generates a varying field 407. In the exemplary embodiment shown in FIG. 4, a gap 410 formed by ledge portions 412 can act as an intensifier. The varying field 407 is shown across the gap 410 with the electric and magnetic field components (denoted $\vec{E}$ and $\vec{B}$) generally along the X and Y axes of the coordinate system, respectively. Since a portion of the varying field can be intensified across the gap 410, the ledge portions 412 can be sized during fabrication to provide a particular magnitude or wavelength of the varying field 407.

A charged particle source 414 (such as the source 120 described with reference to FIGS. 1-3) targets a beam 416 (such as a beam 100) of charged particles (e.g., electrons) along a straight path 420 through an opening 422 on a sidewall 424 of the device 400. The charged particles travel through a space 426 within the gap 410. On interacting with the varying field 407, the charged particles are shown angularly modulated from the straight path 420. Generally, the charged particles travel on an oscillating path 428 within the gap 410. After passing through the gap 410, the charged particles are angularly modulated on a new path 430. An angle β illustrates the deviation between the new path 430 and the straight path 420.

As would be appreciated by one of ordinary skill in the art, a number of resonant structures 402 can be repeated to provide additional electric fields for influencing the charged particles of the beam 416. Alternatively, the direction of the oscillation can be changed by turning the resonant structure 402 on its side onto surface 404.

Figure 5A:
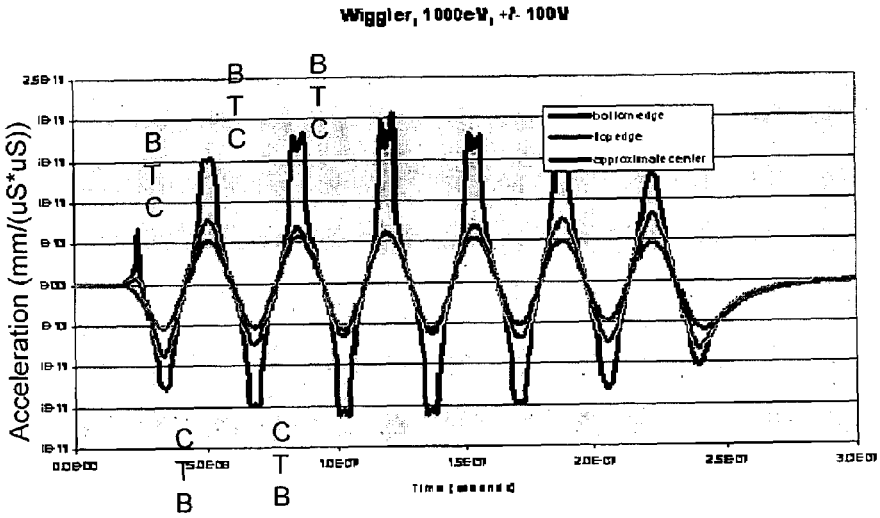
FIG. 5 is the output of a computer simulation showing trajectories and accelerations of model devices according to the present invention.
Figure 5B:
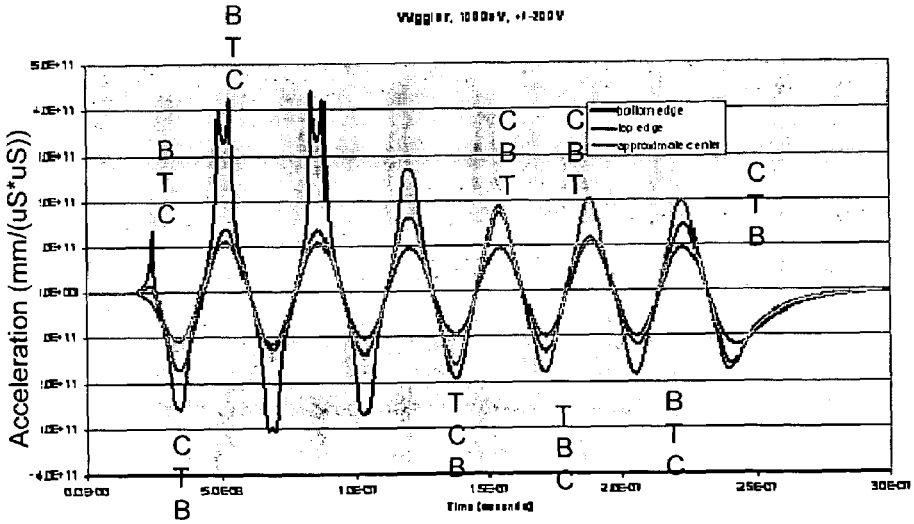
Figure 5C:
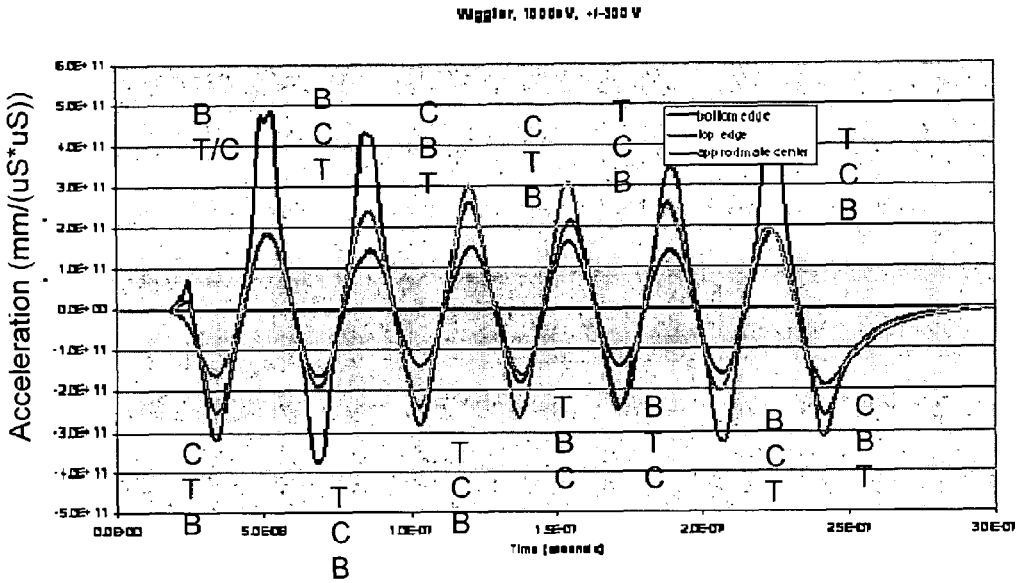

FIGS. 5A-5C are outputs of computer simulations showing trajectories and accelerations of model devices according to the present invention. The outputs illustrate three exemplary paths, labeled "B", "T" and "C" for bottom, top and center, respectively. As shown on FIG. 1, these correspond to charged particles passing through the bottom, top and center, respectively, of the opening between the electrodes 140. Since the curves for B, T and C cross in various locations, the graphs are labeled in various locations. As can be seen in FIG. 5A, the calculations show accelerations of about $0.5\times10^{11}$ mm/μS$^2$ for electrons with 1 keV of energy passing through a field of +/−100 volts when passing through the center of the electrodes. FIG. 5B shows accelerations of about $1.0\times10^{11}$ mM/μS$^2$ for electrons with 1 keV of energy passing through a field of +/−200 volts when passing through the center of the electrodes. FIG. 5C shows accelerations of about 1.0-3.0× $10^{11}$ mm/μS$^2$ for electrons with 1 keV of energy passing through a field of +/−300 volts when passing through the center of the electrodes.

It is also possible to construct the electrode of such a size and spacing that they resonate at or near the frequency that is being generated. This effect can be used to enhance the applied fields in the frequency range that the device emits.

Utilizing the alternating electric fields of the present invention, the oscillating charged particles emit photons to achieve an x-ray emitting device. Such photons can be used to provide x-rays to an outside of the device or to produce x-rays for use internal to the device as well. Moreover, x-rays produced can be used as part of measurement or medical devices.

Figure 6:
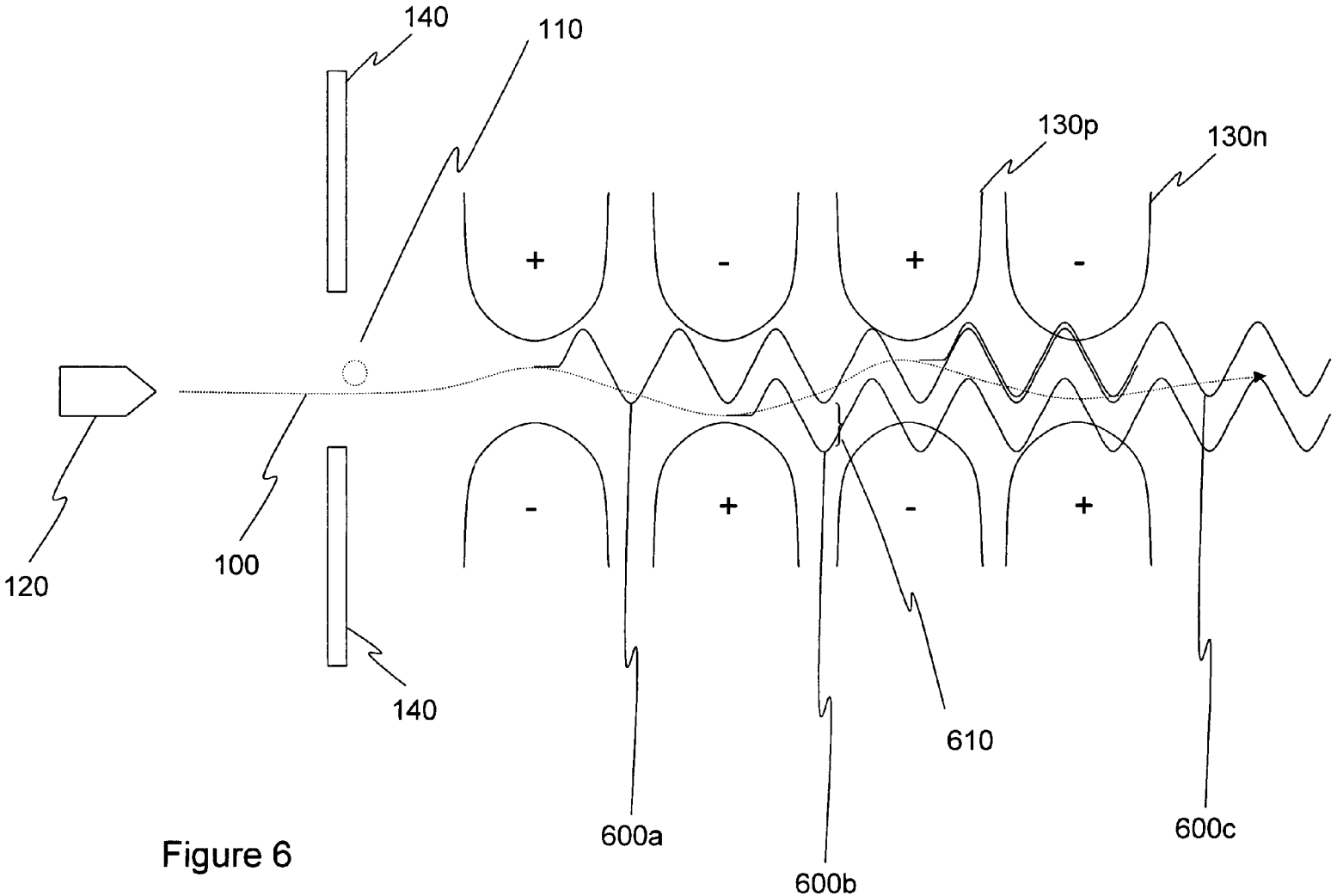
FIG. 6 is a top-view, high-level conceptual representation of a charged particle moving through a series of alternating electric fields according to a first embodiment of the present invention such that photons are emitted in phase with each other.
Figure 7:
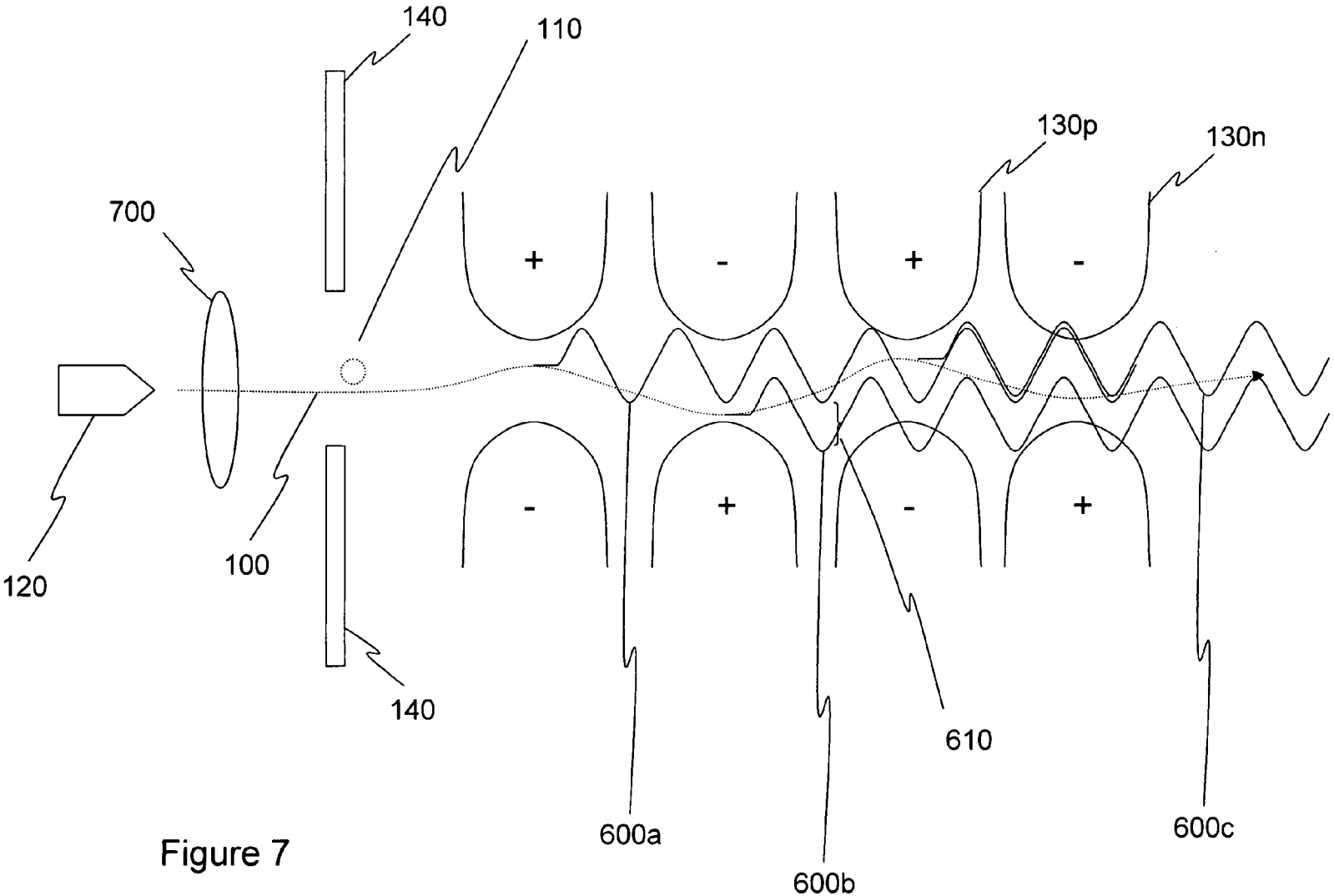
FIG. 7 is a top-view, high-level conceptual representation of a charged particle moving through a series of alternating electric fields according to a second embodiment of the present invention that includes a focusing element.
Figure 8:
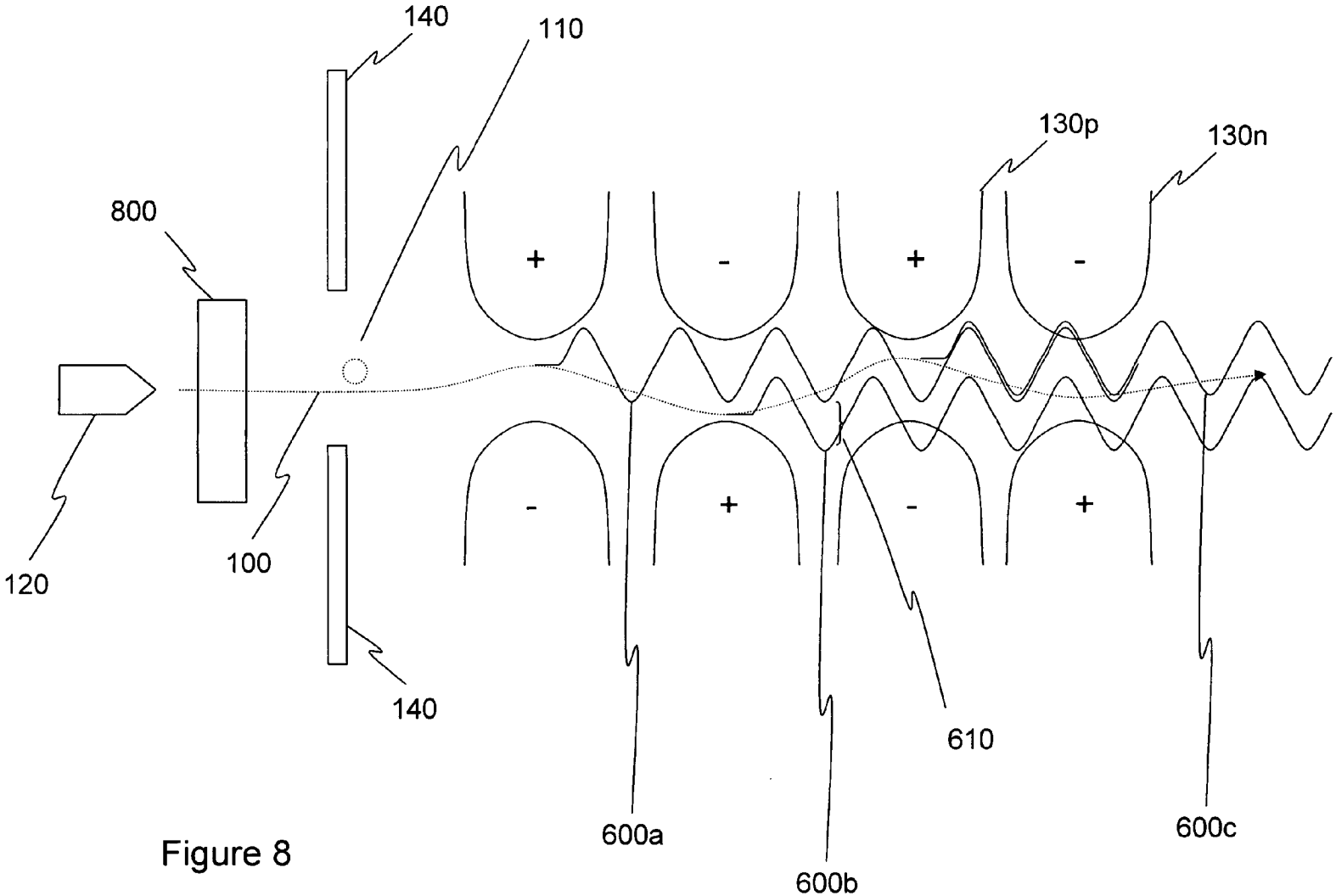
FIG. 8 is a top-view, high-level conceptual representation of a charged particle moving through a series of alternating electric fields according to a third embodiment of the present invention that includes a pre-bunching element.

Turning to FIG. 6, the structure of FIG. 1 has been supplemented with the addition of photons 600*a*-600*c*. In the illustrated embodiment, the electric fields 130*p* and 130*n* are selected such that the charged particles 110 are moved in an oscillating trajectory at (or nearly at) an integral multiple of the emitted x-rays. Using such a controlled oscillation, the electromagnetic radiation emitted at the maxima and minima of the oscillation constructively interfere with the emission at the next minimum or maximum. As can be seen, for example at 610, the photon emissions are in phase with each other. This produces a coherent x-ray source that can be used in x-ray applications, such as medical imaging.

In light of the variation in paths that a charged particle can undergo based on its initial path between electrodes 140, in a second embodiment of a coherent radiation source, a focusing element 700 is added in close proximity to the electrodes 140. The focusing element 700, while illustrated before the electrodes 140 may instead be placed after. In such a configuration, additional charged particles may traverse a center path between the fields and undergo constructive interference.

Figure 9A:
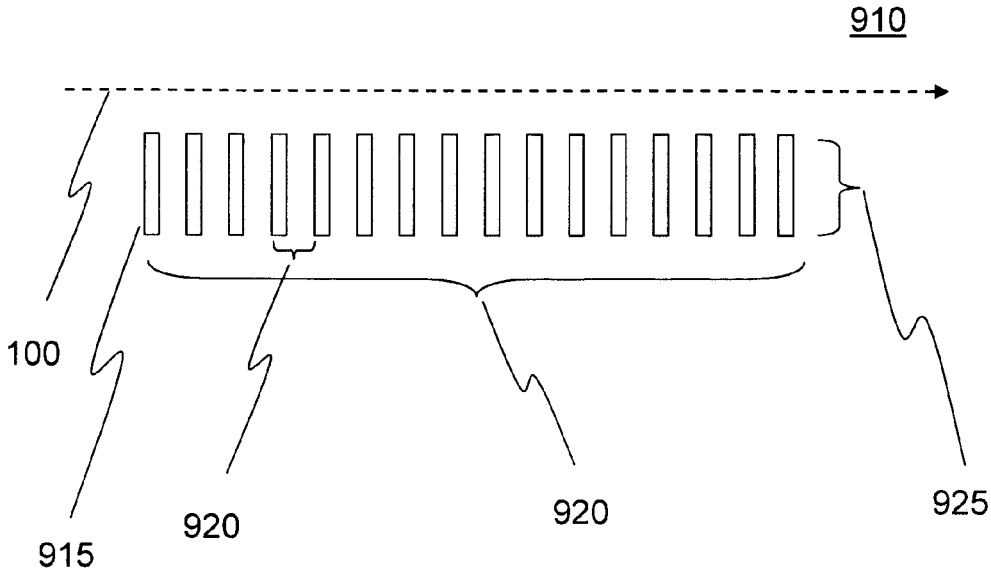
FIGS. 9A through 9H are exemplary resonant structures acting as pre-bunching elements.

In a third embodiment of a coherent x-ray source, a pre-bunching element 800 is added which helps to control the inter-arrival time between charged particles, and therefore aid in the production of coherent Electromagnetic Radiation (EMR). One possible configuration of a pre-bunching element 800 is a resonant structure such as is described in U.S. application Ser. No. 11/410,924 , entitled "Selectable Frequency EMR Emitter," filed on even date herewith and incorporated herein by reference. However, exemplary resonant structures are shown in FIGS. 9A-9H. As shown in FIG. 9A, a resonant structure 910 may comprise a series of fingers 915 which are separated by a spacing 920 measured as the beginning of one finger 915 to the beginning of an adjacent finger 915. The finger 915 has a thickness that takes up a portion of the spacing between fingers 915. The fingers also have a length 925 and a height (not shown). As illustrated, the fingers of FIG. 9A are perpendicular to the beam 100.

Resonant structures 910 are fabricated from resonating material (e.g., from a conductor such as metal (e.g., silver, gold, aluminum and platinum or from an alloy) or from any other material that resonates in the presence of a charged particle beam). Other exemplary resonating materials include carbon nanotubes and high temperature superconductors.

Any of the various resonant structures can be constructed in multiple layers of resonating materials but are preferably constructed in a single layer of resonating material (as described above). In one single layer embodiment, all of the parts of a resonant structure 910 are etched or otherwise shaped in the same processing step. In one multi-layer embodiment, resonant structures 910 of the same resonant frequency are etched or otherwise shaped in the same processing step. In yet another multi-layer embodiment, all resonant structures having segments of the same height are etched or otherwise shaped in the same processing step. In yet another embodiment, all of the resonant structures on a single substrate are etched or otherwise shaped in the same processing step.

The material need not even be a contiguous layer, but can be a series of resonant elements individually present on a substrate. The materials making up the resonant elements can be produced by a variety of methods, such as by pulsed-plating, depositing, sputtering or etching. Preferred methods for doing so are described in co-pending U.S. application Ser. No. 10/917,571, filed on Aug. 13, 2004, entitled "Patterning Thin Metal Film by Dry Reactive Ion Etching," and in U.S. application Ser. No. 11/203,407, filed on Aug. 15, 2005, entitled "Method Of Patterning Ultra-Small Structures," both of which are commonly owned at the time of filing, and the entire contents of each of which are incorporated herein by reference.

At least in the case of silver, etching does not need to remove the material between segments or posts all the way down to the substrate level, nor does the plating have to place the posts directly on the substrate. Silver posts can be on a silver layer on top of the substrate. In fact, we discovered that, due to various coupling effects, better results are obtained when the silver posts are set on a silver layer, which itself is on the substrate.

Figure 9B:
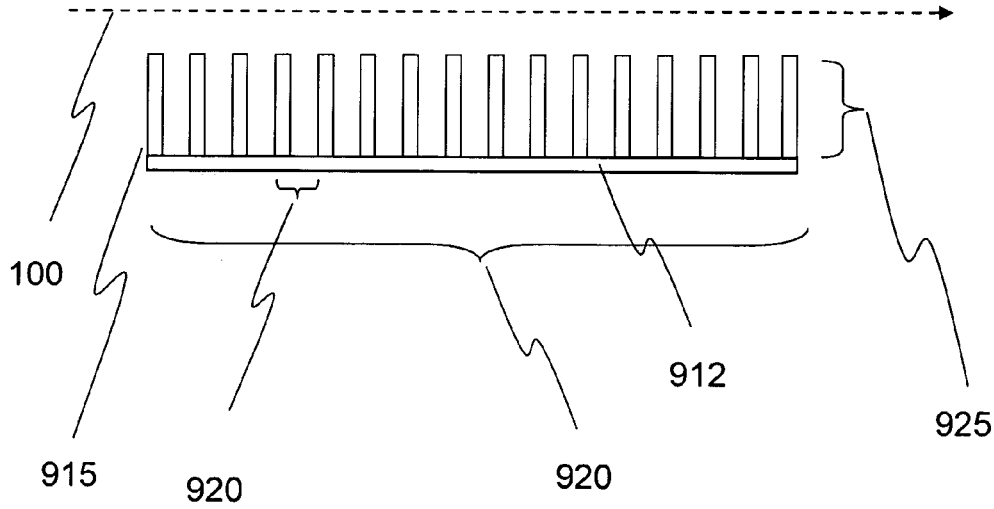
Figure 9C:
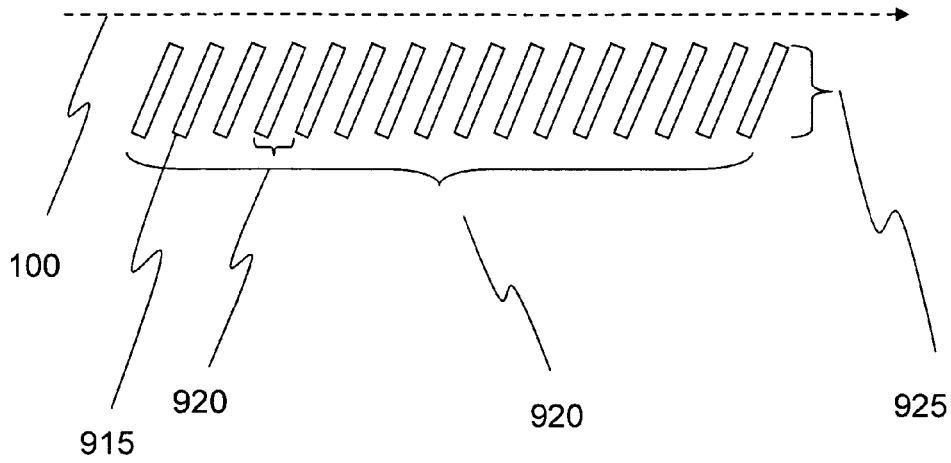
Figure 9D:
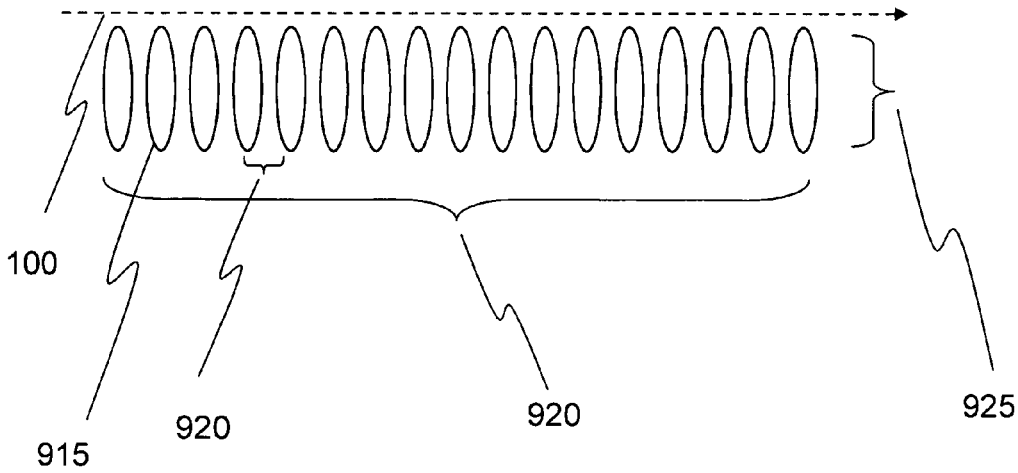
Figure 9E:
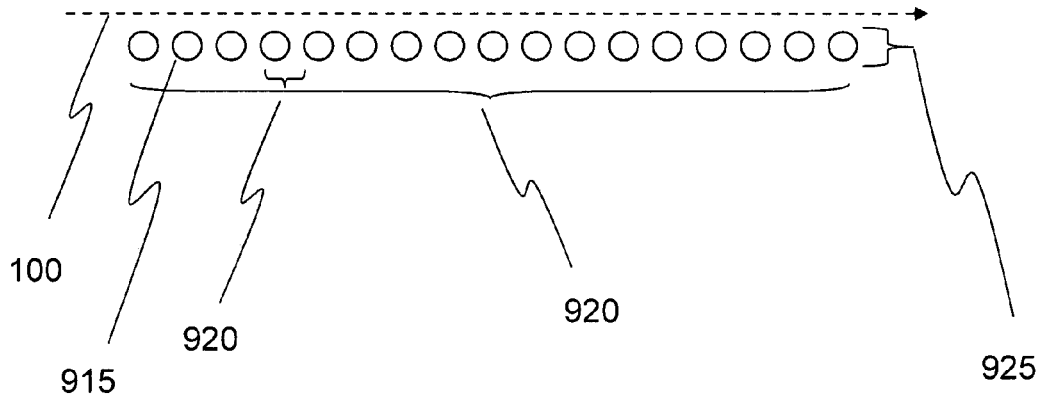
Figure 9F:
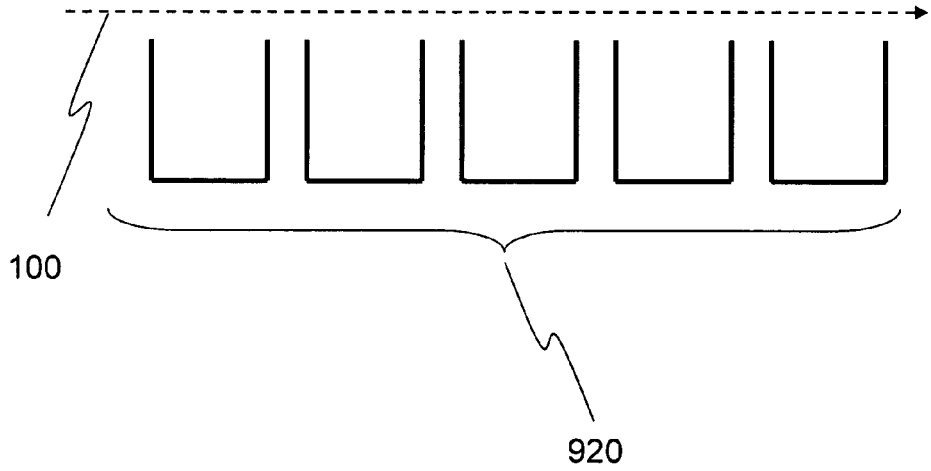
Figure 9G:
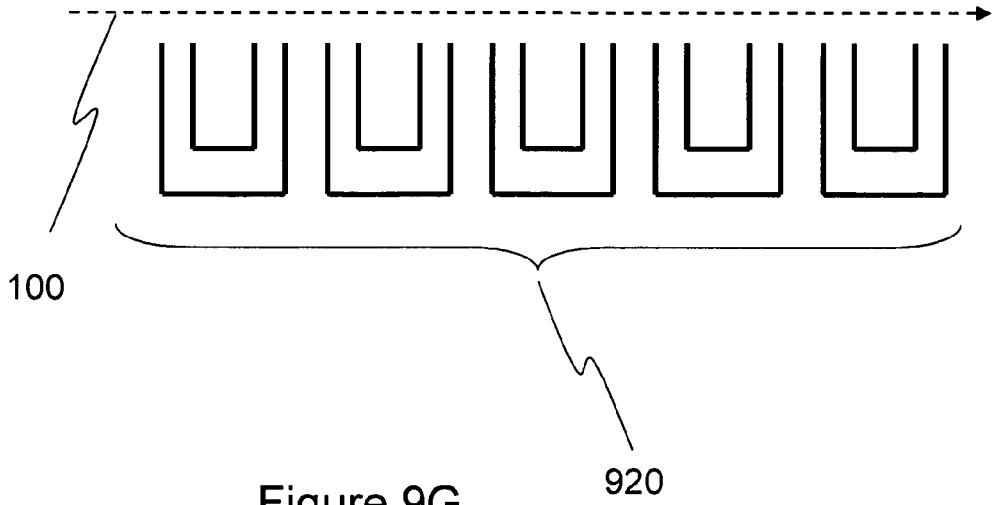
Figure 9H:
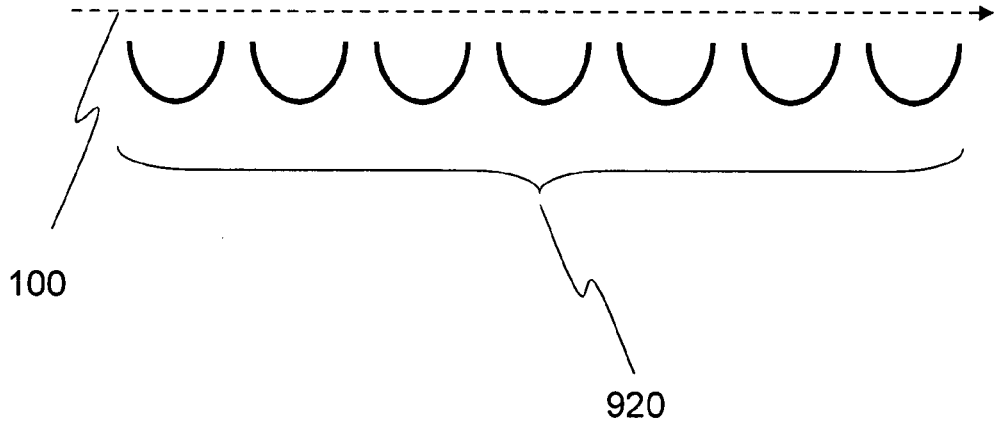

As shown in FIG. 9B, the fingers of the resonant structure 910 can be supplemented with a backbone. The backbone 912 connects the various fingers 915 of the resonant structure 910 forming a comb-like shape on its side. Typically, the backbone 912 would be made of the same material as the rest of the resonant structure 910, but alternate materials may be used. In addition, the backbone 912 may be formed in the same layer or a different layer than the fingers 910. The backbone 912 may also be formed in the same processing step or in a different processing step than the fingers 915. While the remaining figures do not show the use of a backbone 912, it should be appreciated that all other resonant structures described herein can be fabricated with a backbone also.

The shape of the fingers 915 (or posts) may also be shapes other than rectangles, such as simple shapes (e.g., circles, ovals, arcs and squares), complex shapes (e.g., such as semi-circles, angled fingers, serpentine structures and embedded structures (i.e., structures with a smaller geometry within a larger geometry, thereby creating more complex resonances)) and those including waveguides or complex cavities. The finger structures of all the various shapes will be collectively referred to herein as "segments."Other exemplary shapes are shown in FIGS. 9C-9H, again with respect to a path of a beam 100. As can be seen at least from FIG. 9C, the axis of symmetry of the segments need not be perpendicular to the path of the beam 100.

Exemplary dimensions for resonant structures include, but are not limited to:

i. period (920) of segments: 150-220 nm;
ii. segment thickness: 75-110 nm;
iii. height of segments: 250-400 nm;
iv. length (925) of segments: 60-180 nm; and
v. number of segments in a row: 200-300.

Figure 10:
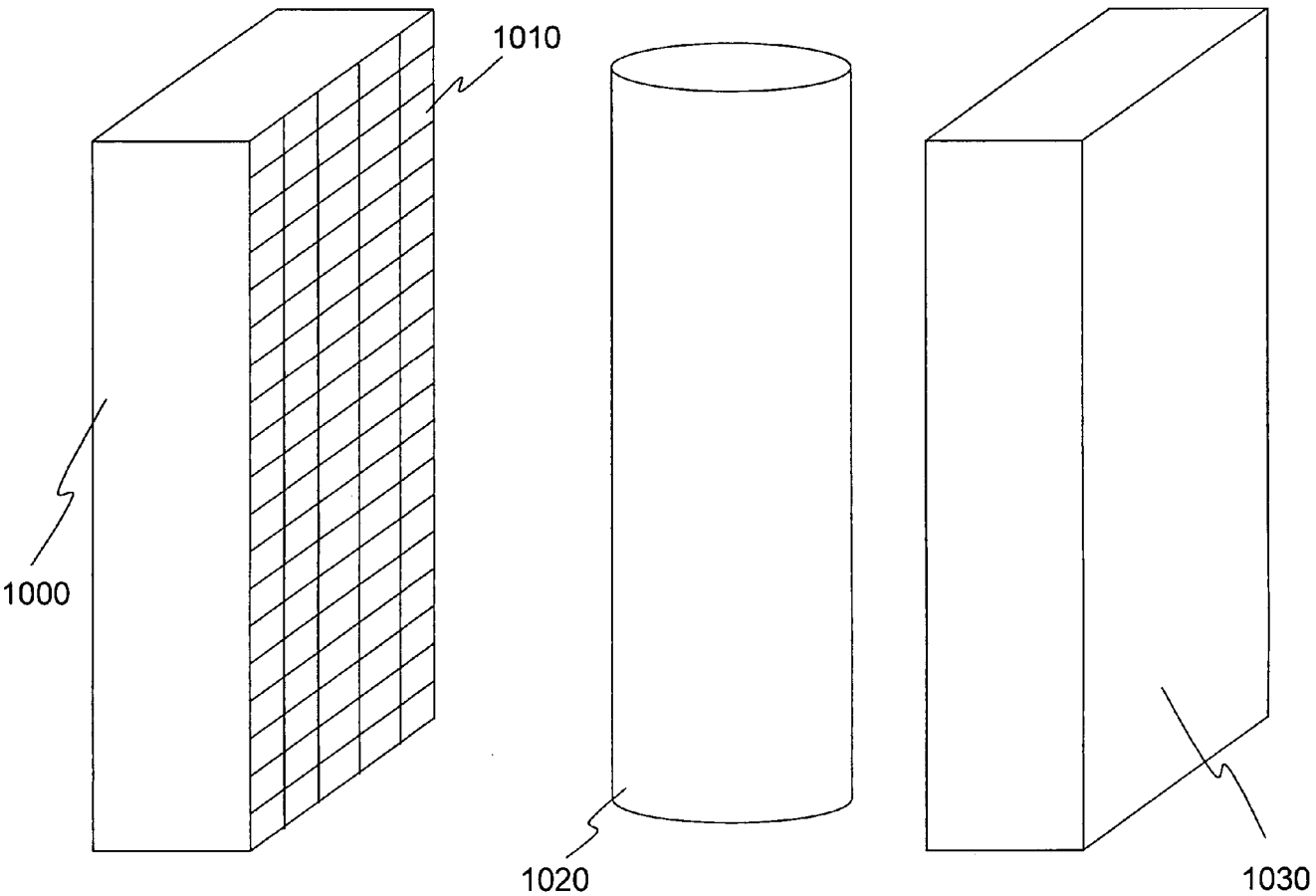
FIG. 10 is a generalized illustration of a coherent source of x-rays being used in a medical imaging environment.

As shown in FIG. 10, the resonant structures according to the present invention can be utilized to construct a coherent source of x-rays 1000. The coherent source of x-rays 1000 emits x-rays from at least one coherent x-ray section 1010 corresponding to a portion of a patient or object 1020 (represented as a cylinder) that is to be examined. At least a portion of the x-rays that pass through the patient 1020 are collected by a detector 1030. The detector 1030 can be conventional x-ray film to be developed or a series of electronic x-ray detectors, or any other device capable of detecting x-rays such as a storage phosphor. While the coherent source of x-rays 1000 and the detector 1030 are illustrated as being planar, they may be formed in any shape desired (e.g., semi-circular).

Moreover, various sections 1010 may be turned on in parallel or in series, in order to achieve the desired amount of radiation and in the desired areas. Similarly, the intensity of the coherent x-rays produced can be controlled by regulating an amount of the charged particles that are passed through the electric fields.

In an x-ray machine such as is shown in FIG. 10, the resonant structures of a section 1010 either can be powered from individual sources for each resonant structure or can be powered with a source that is shared between plural resonant structures. For example, when using a shared source, the path of the beam may be altered so that the beam goes through a number of fields in different locations or even through different sections 1010.

As would be understood by one of ordinary skill in the art, the above exemplary embodiments are meant as examples only and not as limiting disclosures. Accordingly, there may be alternate embodiments other than those described above which nonetheless still fall within the scope of the pending claims.

The invention claimed is:

1. A charged particle accelerating structure comprising:

resonant structures to create a series of alternating electric fields along an intended path;

a source of charged particles configured to transmit charged particles, the charged particles taking an oscillating trajectory through the series of alternating electric fields thereby producing x-rays; and a pre-bunching element, wherein the charged particles are transmitted through the pre-bunching element and through the series of alternating electric fields such that the oscillating trajectory has a wavelength close to a multiple of that of the emitted x-rays during oscillation and wherein the x-rays emitted from the charged particles undergo constructive interference.

2. The structure as claimed in claim 1, wherein the oscillatory trajectory is in a direction substantially perpendicular to the intended path.

3. The structure as claimed in claim 1, wherein the charged particles comprise electrons.

4. The structure as claimed in claim 1, wherein the charged particles comprise positively charged ions.

5. The structure as claimed in claim 1, wherein the charged particles comprise negatively charged ions.

6. The structure as claimed in claim 1, wherein the series of alternating electric fields comprises alternating adjacent electric fields and fields of opposite polarity on opposite sides of the intended path.

7. The structure as claimed in claim 1, wherein at least one of the alternating electric fields is created using a resonant structure configured to resonate at a multiple of an x-ray frequency.

8. The structure as claimed in claim 1, wherein the oscillatory trajectory is in a direction substantially parallel to the intended path.

9. The structure as claimed in claim 1, wherein the pre-bunching element comprises another resonant structure.

10. The structure as claimed in claim 1, further comprising a focusing element.

11. A method of accelerating charged particles, comprising: generating a beam of charged particles;

providing a series of alternating electric fields along an intended path;

transmitting the beam of charged particles along the intended path through the alternating electric fields such that the charged particles produce x-rays; and pre-bunching the charged particles prior to transmitting the beam of charged particles into the alternating electric fields, wherein the oscillating trajectory has a wavelength close to a multiple of that of the emitted x-rays during oscillation and wherein the x-rays emitted from the charged particles undergo constructive interference.

12. The method as claimed in claim 11, wherein the oscillatory path is in a direction perpendicular to the intended path.

13. The method as claimed in claim 11, wherein the charged particles comprise electrons.

14. The method as claimed in claim 11, wherein the charged particles comprise positively charged ions.

15. The method as claimed in claim 11, wherein the charged particles comprise negatively charged ions.

16. The method as claimed in claim 11, wherein the series of alternating electric fields comprises alternating adjacent electric fields and fields of opposite polarity on opposite sides of the intended path.

17. The method as claimed in claim 11, wherein at least one of the alternating electric fields is created using an ultra-small resonant structure configured to resonate at a multiple of an x-ray frequency.

18. The method as claimed in claim 11, wherein the oscillatory path is in a direction substantially parallel to the intended path.

19. The method as claimed in claim 11, wherein the step of pre-bunching comprises passing the beam of charged particles close enough to a resonant structure to cause the resonant structure to resonate.

20. The method as claimed in claim 11, further comprising focusing the charged particles prior to substantially a center of the alternating electric fields prior to transmitting the beam of charged particles into the alternating electric fields.

21. An x-ray machine comprising:

plural charged particle accelerating structures each comprising:

resonant structures to create a series of alternating electric fields along an intended path; and a source of charged particles configured to transmit charged particles, the charged particles taking an oscillating trajectory through the series of alternating electric fields such that x-rays are emitted during oscillation, wherein at least one of the sources of charged particles is shared between at least two of the plural charged particle accelerating structures.

22. The x-ray machine as claimed in claim 21, wherein the source of charged particles is separate for each of the plural charged particle accelerating structures.

23. The x-ray machine as claimed in claim 21, further comprising a pre-bunching element, wherein the charged particles are transmitted through the pre-bunching element and through the series of alternating electric fields such that the oscillating trajectory has a wavelength close to a multiple of that of the emitted x-rays during oscillation and wherein the x-rays emitted from the charged particles undergo constructive interference.

24. The structure as claimed in claim 9, wherein the resonant structure comprises an ultra-small resonant structure.

25. The method as claimed in claim 19, wherein the resonant structure comprises an ultra-small resonant structure.

* * * * *